US008128443B2

(12) United States Patent
Gai et al.

(10) Patent No.: US 8,128,443 B2
(45) Date of Patent: Mar. 6, 2012

(54) SINGLE LEVER CONTROL FOR COMBINED CONTROL OF THE THROTTLE IN A MARINE ENGINE AND OF A REVERSING GEAR

(75) Inventors: Giorgio Gai, Genoa (IT); Marco Campagna, Genoa (IT)

(73) Assignee: Ultraflex S.p.A., Casella (GE) (IT)

( * ) Notice: Subject to any disclaimer, the term of this patent is extended or adjusted under 35 U.S.C. 154(b) by 192 days.

(21) Appl. No.: 12/512,302

(22) Filed: Jul. 30, 2009

(65) Prior Publication Data

US 2010/0029150 A1 Feb. 4, 2010

(30) Foreign Application Priority Data

Aug. 1, 2008 (IT) ..... GE2008A0068

(51) Int. Cl.
*B60W 10/04* (2006.01)
*G05G 9/00* (2006.01)

(52) U.S. Cl. ..... 440/86; 440/87; 74/471 R

(58) Field of Classification Search ..... 440/1, 84, 440/85, 86, 87; 477/89, 112, 113; 114/440 RE; 74/471 R See application file for complete search history.

(56) References Cited

U.S. PATENT DOCUMENTS 1,881,251 A * 10/1932 Tobener, Jr ..... 123/146.5 D (Continued)

FOREIGN PATENT DOCUMENTS

EP 325094 A * 7/1989

(Continued)

*Primary Examiner* — Lars A Olson
*Assistant Examiner* — Andrew Polay
(74) *Attorney, Agent, or Firm* — Themis Law

(57) ABSTRACT

A single lever control for combined control of the throttle in a marine engine and of a reversing gear includes a rocking lever mounted onto a supporting arm, which is connected to an actuator causing a reversing gear to transmit engine motion to a shaft driving a propeller or the like either in the same direction of rotation as the drive shaft or opposite thereto. The supporting arm is also dynamically connected to position sensors sensing the angular position of the lever and generating a signal uniquely related thereto. The signal is transmitted to a controller of a motorized actuator of the engine throttle. The angular displacement of the lever is transmitted to a transducer converting rotary motion into an electric signal uniquely related thereto via a gear drive having an input gear controlled by the supporting arm and an output gear connected to a transducer control shaft.

8 Claims, 3 Drawing Sheets

U.S. PATENT DOCUMENTS 2,444,364 A * 6/1948 Panish ..... 477/6
2,475,066 A * 7/1949 Wahlberg ..... 318/625
2,702,615 A * 2/1955 Morse ..... 477/113
2,733,615 A * 2/1956 Cummings ..... 74/354
2,847,870 A * 8/1958 Erxleben ..... 477/34
2,867,132 A * 1/1959 Schroeder ..... 477/99
3,527,186 A * 9/1970 Wennberg et al. ..... 114/144 R
3,640,155 A * 2/1972 Waner et al. ..... 477/112
3,990,319 A * 11/1976 Hofer ..... 74/471 XY
4,119,186 A * 10/1978 Choudhury et al. ..... 477/113
4,334,130 A * 6/1982 Beig ..... 200/61.54
4,422,242 A * 12/1983 Stocker ..... 33/600
4,470,492 A * 9/1984 Kobelt ..... 477/113
4,507,979 A * 4/1985 Zebrowski ..... 74/89.22
4,561,398 A * 12/1985 Roca Nierga ..... 123/449
4,573,348 A * 3/1986 Abramson et al. ..... 73/115.02
4,583,417 A * 4/1986 Hurlow ..... 74/473.15
4,891,999 A * 1/1990 Scott ..... 74/337.5
5,080,619 A * 1/1992 Uchida et al. ..... 440/84
5,083,951 A * 1/1992 Baba ..... 440/86
5,122,084 A * 6/1992 Lieb et al. ..... 440/86
5,127,858 A * 7/1992 Pelligrino et al. ..... 440/84
5,228,548 A * 7/1993 Bohlin ..... 477/112
5,231,890 A * 8/1993 Hayasaka ..... 74/501.6
5,256,092 A * 10/1993 Jones ..... 440/87
5,280,282 A * 1/1994 Nagafusa et al. ..... 340/5.3
5,318,466 A * 6/1994 Nagafusa ..... 440/86
5,327,843 A * 7/1994 Gai ..... 114/144 R
5,352,138 A * 10/1994 Kanno ..... 440/1
5,408,230 A * 4/1995 Okita ..... 340/12.22
5,423,277 A * 6/1995 Gai ..... 114/144 R
5,492,493 A * 2/1996 Ohkita ..... 440/86
5,539,294 A * 7/1996 Kobayashi ..... 318/675
5,545,064 A * 8/1996 Tsunekawa et al. ..... 440/53
5,665,025 A * 9/1997 Katoh ..... 477/107
5,741,166 A * 4/1998 Newman ..... 440/84
6,015,319 A * 1/2000 Tanaka ..... 440/84
6,050,866 A * 4/2000 Bass ..... 440/84
6,264,512 B1 * 7/2001 Muller ..... 440/50
6,443,083 B2 * 9/2002 Muller ..... 114/144 RE
6,481,203 B1 * 11/2002 Johnson et al. ..... 60/487
6,485,340 B1 * 11/2002 Kolb et al. ..... 440/84
6,511,354 B1 * 1/2003 Gonring et al. ..... 440/87
6,588,354 B2 * 7/2003 Gai ..... 114/144 R
RE39,032 E * 3/2006 Gonring et al. ..... 440/87
7,247,066 B2 * 7/2007 Harada et al. ..... 440/84
2005/0241425 A1 * 11/2005 Oguma ..... 74/473.1
2005/0284446 A1 * 12/2005 Okuyama ..... 123/350
2006/0189226 A1 * 8/2006 Blair ..... 440/84
2007/0249244 A1 * 10/2007 Watanabe et al. ..... 440/84
2008/0041288 A1 * 2/2008 Bosia et al. ..... 114/162
2009/0030567 A1 * 1/2009 Gai et al. ..... 701/21
2009/0221196 A1 * 9/2009 Blair ..... 440/87
2011/0030492 A1 * 2/2011 Gai et al. ..... 74/473.2

FOREIGN PATENT DOCUMENTS

JP 2006341676 A * 12/2006

* cited by examiner

SINGLE LEVER CONTROL FOR COMBINED CONTROL OF THE THROTTLE IN A MARINE ENGINE AND OF A REVERSING GEAR

FIELD OF THE INVENTION

The invention relates to a single lever control for combined control of the throttle, i.e. the number of revolutions, in a marine engine and of a reversing gear. The single lever control includes a rocking lever mounted onto a supporting arm, which is dynamically connected via a mechanical transmission system to the actuator of a reversing gear for switching the reversing gear into a state, in which the engine motion is transmitted to a shaft for driving a propeller or the like either in the same direction of rotation as the drive shaft or opposite thereto. The rocking lever supporting arm is also dynamically connected to position sensors adapted to sense the angular position of the lever and to generate a signal uniquely related to such angular position, which signal is transmitted to a controller of a motorized actuator of the engine throttle.

BACKGROUND OF THE INVENTION

Single lever controls are well known and widely used in the art. For example, the owner hereof sells single-lever control of this type, as shown by Ultraflex catalog, pages 23 to 32, year 2008. The rocking lever controls a rocker arm via the supporting arm and a transmission system, which rocker arm has at its two ends a drive cable connected thereto, to transmit the angular displacement of the rocker arm to the member for switching the motion transmission state of the reversing gear, which may also be, for instance, a rocker arm keyed to motion reversal mechanisms control shaft.

When the lever is in a neutral position, the rocker arm is in a position in which the reversing gear is in an idle state, with motion transmission between the drive shaft and the propeller shaft being prevented. Starting from said neutral angular position, the initial angular displacement of the lever in a first direction and in a direction opposite to the former first causes a corresponding pivotal motion of the rocker arm, and said displacement stroke is transmitted by the cables to the actuator of the reversing gear which is thus switched into a state in which the engine shaft motion is transmitted to the propeller shaft with the two shafts rotating in the same direction and into a state in which the engine shaft motion is transmitted to the propeller shaft with said two shafts rotating in different, i.e. opposite directions. This corresponds to the forward and reverse gear of the boat. During said initial angular displacement stroke of the lever in either direction, the engine is maintained at idle speed, i.e. in a throttle condition in which the drive shaft runs a minimum number of revolutions. This allows the reversing gear to be switched from its idle state into the forward gear or reverse gear or from the forward gear directly into the reverse gear or vice versa, without being damaged, i.e. avoiding the damages that it might incur if the engine were in an accelerated state, with the drive shaft rotating at a high rpm.

Once the reversing gear has reached its switched state, any further stroke of the control lever is converted into an engine acceleration control, i.e. an increase of fuel or fuel-air mixture delivery.

It is apparent from the above that high accuracy is required of the transducers that convert the angular position of the control lever and the angular displacement thereof, and that position detection must be repeatable, i.e. not subject to drifts caused by inaccurate conversion of the position or motion into electric signals. In case of inaccurate correlation of the angular position or stroke of the lever to the generated electric signal, there may be no correct synchronism between the mechanical control of the reversing gear and the acceleration state, i.e. the number of revolutions of the above described engine.

This drift in the correlation of the angular position or stroke of the lever to the electric signal may be caused by excessive transducer tolerances or inaccuracies and clearances in angular motion transmission from the control lever to the transducer.

Such problems cannot be obviated by simply using more accurate, and accordingly more expensive transducers. Therefore, even with higher transducer accuracy, there will be no increase in the accuracy of control lever position reading and transmission and no repeatability of said position detection, and synchronism with the reversing gear position and control cannot be perfectly maintained.

SUMMARY OF THE INVENTION

The object of the present invention is to provide a single-lever control as described hereinbefore that uses simple and inexpensive arrangements to increase detection accuracy and repeatability of such detection, by advantageously allowing the use of more accurate transducers without incurring drawbacks associated with the loss or degradation of control lever function or higher transducer costs, with no higher accuracy being generally ensured.

The invention fulfils these objects by providing a single-lever control of the above mentioned type, in which the angular displacement of the lever is transmitted to a transducer which converts rotary motion into an electric signal uniquely related thereto via a gear drive, the input gear being controlled by the rocking lever supporting arm and the output gear being rotatably connected with the transducer control shaft.

In an advantageous embodiment, the rocking lever supporting arm carries a coaxial gear wheel which acts as the input gear of the gear drive, the latter being engaged with a gear wheel keyed to the transducer shaft.

Any required gear ratios may be obtained, and gear trains may be also particularly provided, e.g. in which the gear wheel keyed to the control shaft engages with a first pinion which is rotatably integral with a coaxial transmission gear wheel, which in turn engages with an output pinion coaxially keyed to the transducer shaft. This also allows fine adjustment of gear ratios, by simply replacing the gear wheel on the transducer shaft with a pinion and by placing an intermediate element between the gear wheel on the control shaft and the pinion on the transducer shaft, which element consists of two coaxial integral gear wheels having different numbers of teeth.

The gear wheels and the pinions of the gear drive have such a size as to provide a predetermined gear ratio, which may be a gear-up a gear-down ratio or a 1 to 1 gear ratio.

As a further improvement, this single-lever control may simultaneously control two or more transducers, each being designed to control the throttle adjusting actuator of a corresponding engine of the two or more engines on the boat.

The particular constructions as described above may be integrated together to control said two or more transducers, the gear wheel keyed to the control lever supporting arm being engaged with the pinion of a separate gear train for each of said two or more transducers.

Advantageously, the gears of each drive unit for each transducer may be identical.

When two transducers are used, these may be located in symmetrically opposite angular positions with respect to a center axis that passes through the axis of the control lever supporting arm and parallel to said lever in the neutral angular position.

Concerning the transducers, various types of transducers may be used. Hall effect position transducers, also known as Hall effect potentiometers, have been found to be the least expensive, resistant and reliable transducers.

These types of transducers are known in the art and include a shaft rotating about its own axis, which carries a permanent magnet. The rotation imparted to the magnet by the shaft causes a sinusoidal voltage fluctuation in a Hall element. Such fluctuation is later amplified. Thus, the sinusoidal signal of the Hall element may be used to generate a signal uniquely related to the angular position and/or angular displacement, as well as the speed at which such angular displacement occurred. As compared with traditional resistance potentiometers, Hall effect potentiometers have the advantage of not having wiping contacts, and hence of not being subjected to deterioration with time, for instance due to oxidation, which is a very important feature in marine environments. Apart from any degradation of the electronic circuits associated with the transducer, such as the amplifier, if any, or else, the transducer in itself would not be affected by being immersed in or wetted with water, which is also a highly advantageous feature in the nautical field. However, this type of potentiometers cannot ensure very high angular resolutions, and sufficiently small angular displacements of the control lever can be only measured by providing a high-gear ratio transmission of the control lever motion to the transducer shaft. A Hall effect potentiometer is sold, for instance, by Fae, based in Milan, under the name P32.

The above description clearly shows that, using less accurate sensors, i.e. with a lower resolution, and very simple and inexpensive construction arrangements, the single-lever controls as described hereinbefore may have a lower cost, with no function loss, but with considerably improved features, and providing a highly stronger and reliable single-lever control, especially in particular conditions of use, as is usual in the nautical field.

Further improvements will form the subject of the dependent claims.

BRIEF DESCRIPTION OF THE DRAWINGS

The characteristics of the invention and the advantages deriving therefrom will appear more clearly from the following description of a non-limiting embodiment which is illustrated in the accompanying drawings, in which.

DETAILED DESCRIPTION OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
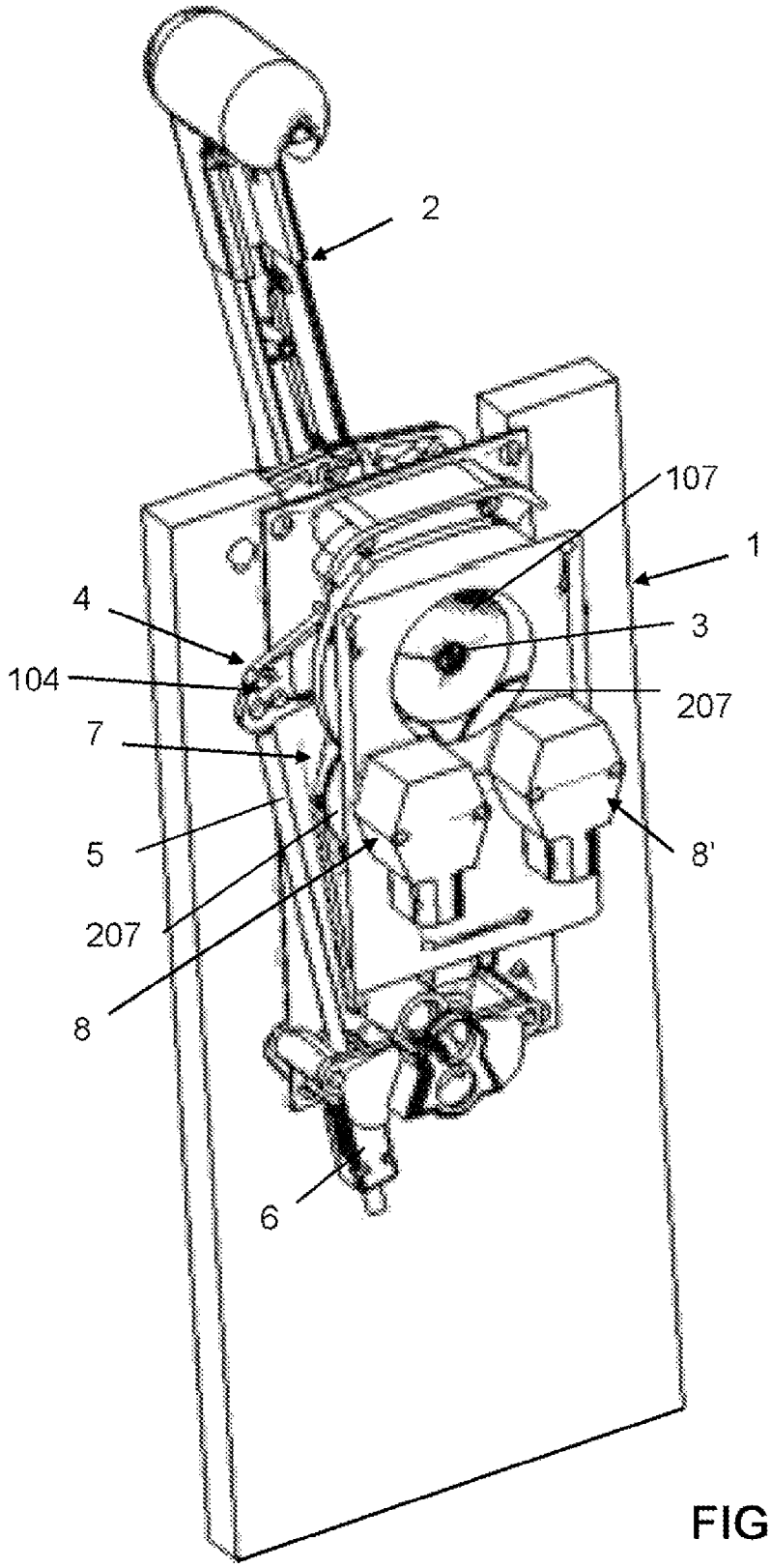
FIG. 1 is a perspective view of a single-lever control in the typical bulkhead-mounted configuration with the control rocking lever on the outer side of the bulkhead and the controlling mechanism on the inner side of the bulkhead.
Figure 2:
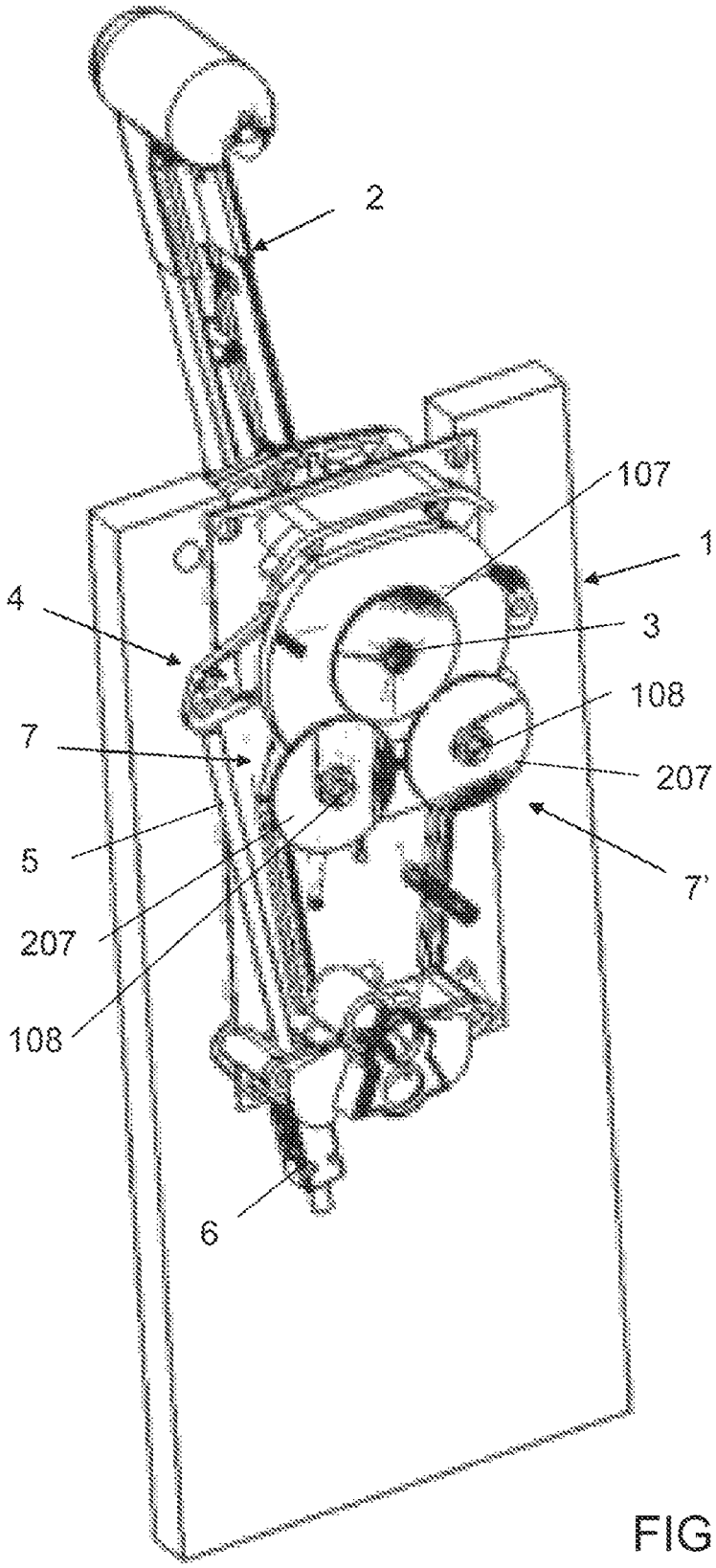
FIG. 2 shows the single-lever control of FIG. 1, with the wall for supporting the two transducers being omitted.

FIGS. 1 and 2 show a typical single-lever control of the bulkhead-mounted type, i.e. designed to be mounted to a boat partition 1 that delimits a compartment, such as a peak or the like, which forms the housing for the lever actuated mechanism and for transmission connections.

This embodiment shall be intended without limitation, and its inventive technical and construction features may be transferred, without requiring any inventive step, to single-lever control configurations including a case for the lever-controlled mechanism, such as dash panel configurations or other similar configurations.

The above described embodiment shall be considered without limitation concerning the construction of the gear train/s, each of which may be composed of at least two gears or more, engaged together in a cascade arrangement.

The illustrated embodiment with a 1 to 1 gear ratio is also to be considered without limitation, the gear wheels of the control lever supporting arm and of the shafts of the transducer/s having identical diameters and numbers of teeth.

In this embodiment, the single-lever control comprises a lever 2 that is rotatably fixed by one of its ends to a supporting arm 3 which extends into the compartment delimited by the bulkhead 1. A rocker arm 4 is pivotally fixed and pivots about an axis parallel to the axis of the control arm 3, and is dynamically connected to the arm 3 so that, when the control lever 2 is displaced from a so-called neutral starting position, e.g. a vertical position, during the first part of the pivoting stroke the rocker arm 4 is pivoted in the same pivoting direction as the angular displacement of the control lever. A cable 5 is connected to the opposite ends 104 of the rocker arm to transmit the angular stroke of the rocker arm, with the opposite end thereof being connected to a reversing gear controlling member. Thus, any pivotal motion in either direction of the rocker arm 4, caused by the initial angular displacement stroke of the control lever 2 from a neutral position, in either opposite direction, causes the reversing gear to be switched from the forward gear state to the reverse gear state, i.e. from a state in which it transfers the drive shaft motion to the propeller with the propeller rotating in the same direction of rotation as the drive shaft, to a state in which the rotary motion of the drive shaft is transferred to the propeller in a reverse direction with respect to the drive shaft.

Metal transmission cables 5 are guided through guide sheaths held in special end retainers 6.

An input gear wheel 107 is further integrally rotatably keyed to the supporting arm 3, which gear wheel is shared by two gear drive units 7, 7', each disposed to engage the common input gear wheel 107 and transferring the rotary motion of the supporting arm 3, with a predetermined gear ratio, to a respective angular position or displacement sensor/transducer, generally designated with numerals 8, 8'.

The angular position or displacement sensors 8, 8' have an input shaft 108, 108', which is rotatably controlled by an output gear wheel 207 of the gear drives 7, 7', which is keyed to the input shaft 108, 108' of each of the two angular position and/or displacement sensors.

The gear wheels 107 and 207 are directly engaged with each other, no additional intermediate gears being provided therebetween. However, if gear-up or gear-down ratios are required, to increase or reduce the input rpm, then gear drives may be equipped with successively engaged gear trains. In a particularly advantageous embodiment, allowing quick replacement and not increasing the transmission size, a gear train designed to obtain a predetermined gear ratio is located between the input gear wheel 107 shared by the two drive units 7, 7' and the output pinions 207 of the two drives, each being mounted to the shaft of one of the two angular position or displacement sensors 8, 8'.

In one embodiment, the intermediate gear train comprises, for each drive unit 7, 7', a pinion which is engaged with the input gearwheel 107 and is coaxially and rotatably integrally fixed to a gear wheel engaging with the output pinion 207 of the input shaft 108, 108' of the corresponding angular position or displacement sensor 8, 8'.

Here, at certain gear ratios or gear ratio ranges, the input gear wheel 107 keyed to the arm 3 for supporting the control lever 2 may be relatively large, with such a circumference as to allow the two gear trains and their respective angular position or displacement sensors 8, 8' to be placed in relatively close positions, symmetrically opposed with respect to a plane of symmetry that passes through the axis of the supporting arm 3 and is parallel to the axis of the control lever 2 in its neutral position, i.e. in its vertical position.

The use of two angular position or displacement sensors 8, 8' allows control of the acceleration state, i.e. the throttle, of each individual engine, when the boat is equipped with two engines. If a single engine is provided, one sensor 8, 8' with a corresponding gear drive 7 will be only required and present.

Likewise, if three or four engines are provided, then each of them may be associated with a separate angular position or displacement sensor 8, with a gear drive for dynamic connection to the common input gear wheel 107.

It shall be noted that the mechanism for transferring the angular displacement of the control lever 2 to the rocker arm 4 is known per se and is not part of the present invention, therefore it will not be further described in detail, because it is not relevant to the invention.

The angular position sensor/s 8, 8' may be of traditional type, such as resistive potentiometers, or of other type. Nevertheless, these types of sensors are expensive and unreliable in terms of safety and consistent operation when subjected to marine environment aggressions, which may lead to performance degradation or permanent damages thereto.

For this purpose, a so-called Hall effect potentiometer is used as a sensor 8, 8'.

Figure 3:
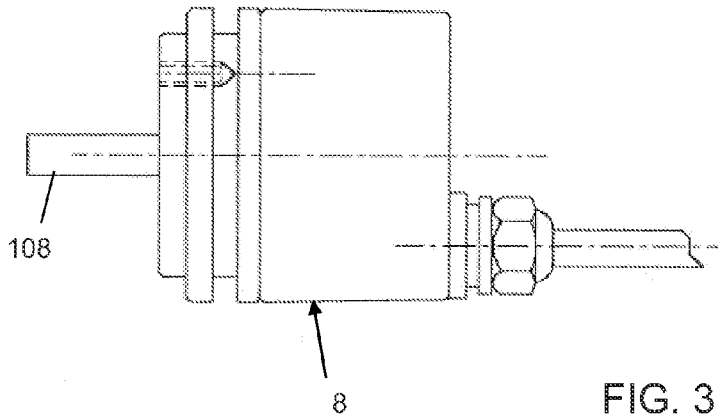
FIG. 3 shows an exemplary Hall effect potentiometer.
Figure 4:
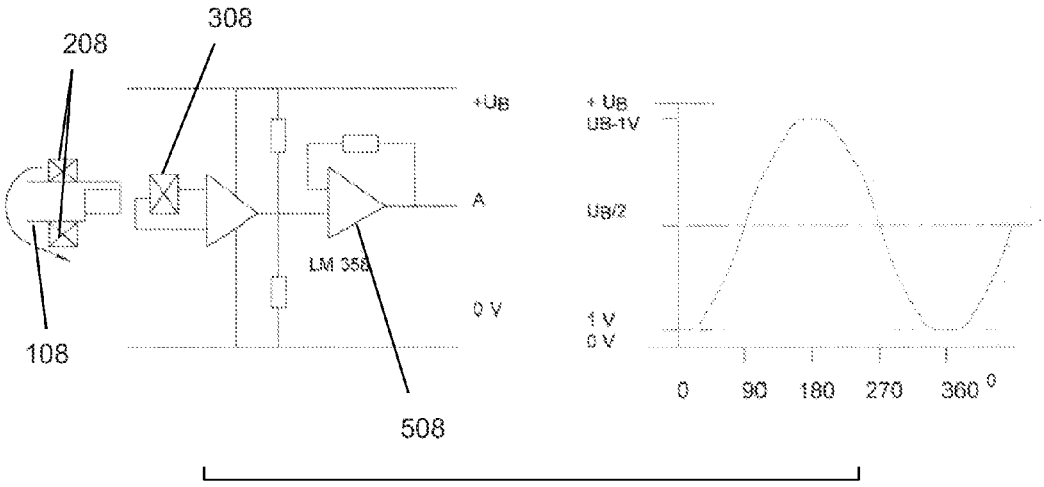
FIG. 4 shows a block diagram of the electromagnetic circuit of said Hall effect potentiometer, with an example of sinusoidal output signal.

Referring now to FIGS. 3 and 4, the construction of a Hall effect potentiometer comprises an input shaft 108 that carries a permanent magnet 208. The permanent magnet cooperates with one or more Hall probes 308 which are fixedly placed in a case in diametrically opposite positions, with respect to the axis of the input shaft 108. The output of Hall sensors 308 is provided to an amplification section 508 and transferred from the latter to an electronic circuit for processing a control signal related to the angular position information concerning the control lever 2 or the angular displacement thereof, as provided by the Hall sensors of the Hall effect potentiometer. Such signal is forwarded to a control unit of an acceleration adjustment actuator, which adjusts the number of revolutions of the engine, by varying the throttle, i.e. the amount of fuel or fuel-air mixture delivered to the engine. Typically, the actuator controls the throttle valve of the engine or, in case of an electronically powered engine, the electronic power control unit thereof.

It will be appreciated that the Hall effect potentiometer is free from any corrosion problem, no contact existing between moving and stationary parts. This also prevents any damage to the sensor, when it contacts water or is exposed to high humidity.

Concerning accuracy and repeatability of control lever angular position detection, the lever controls both the engine rpm and the switching state of the reversing gear, which advantageously allows the reversing gear to be switched between the forward gear, reverse gear and idle (neutral) states with the engine operating at minimum rpm. Using a traditional construction for the transmission of the angular motion of the control lever 2 to an angular position or displacement sensor or transducer, with high mechanical tolerances of the transmission, a deviation would occur between the lever position in which the reversing gear is switched and the lever position in which the engines run at minimum rpm. In this condition, the reversing gear might be damaged upon switching, and/or switching may even be prevented, because the reversing gear cannot be switched at high rpm, in spite of the force applied thereto.

With the invention, this effect can be avoided, and the higher accuracy of the sensors or transducers 8, 8' may be fully utilized. The transmission between the control lever 2 and the input shafts 108 is so accurate and the transmission of the control lever motion to the transducer is so accurate and free of any clearance, that no synchronization drift or deviation occurs between the minimum rpm state of the engine and the reversing gear switching state, and the throttle or number of revolutions of the engine and the switching state of the reversing gears are always repeatable for substantially the same angular position of the control lever 2.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

What is claimed is:

1. A single lever control providing combined control of an engine throttle in a marine engine and a reversing gear, the single lever control comprising:

a rocking lever;

a supporting arm operatively coupled to the rocking lever;

a rocker arm dynamically connecting the supporting arm to an actuator of a reversing gear such to switch the reversing gear into a state, in which engine motion is transmitted to a shaft driving a propelling element either in a same direction of rotation as a drive shaft or opposite thereto, the rocker arm being configured to pivot and cause displacement of a cable interposed between the rocker arm and the actuator;

position sensors dynamically connected to the supporting arm, the position being adapted to sense an angular position of the rocking lever and to generate a signal uniquely related to the angular position of the rocking lever, the signal being transmitted to a controller of a motorized actuator of the engine throttle; and a gear drive having an input gear and an output gear wheel, the gear drive transmitting an angular displacement of the rocking lever to a transducer configured as a Hall effect sensor, which converts rotary motion into an electric signal uniquely related thereto, the input gear being controlled by the supporting arm and the output gear being rotatably connected to a transducer shaft.

2. The single lever control of claim 1, wherein the supporting arm is fixedly coupled to a coaxial gear wheel which acts as the input gear of the gear drive, causing the supporting arm to be directly engaged with the output gear wheel that is configured as an output pinion coaxially and fixedly coupled to the transducer shaft.

3. The single-lever control of claim 2, wherein the input and output gears are sized to provide a predetermined gear ratio.

4. The single lever control of claim 2, wherein there are a plurality of marine engines, and wherein the single lever control simultaneously controls a plurality of transducers each designed to control a throttle adjusting actuator of a corresponding marine engine, the gear wheel fixedly coupled to the supporting arm being directly engaged with at least one output pinion fixedly coupled to each of the plurality of transducers or with at least one output pinion of a separate gear train for each of the plurality of transducers.

5. The single lever control of claim 4, wherein the gear wheel fixedly coupled to the supporting arm engages a gear assembly configured to provide a gear-up or gear-down ratio, a separate drive unit being provided for each of the plurality of transducers.

6. The single lever control of claim 5, wherein each drive unit comprises identical gears.

7. The single lever control of claim 2, further comprising an intermediate transmission element engaged between the gear wheel fixedly coupled to the supporting arm and the pinion fixedly coupled to the transducer shaft, the intermediate transmission element being a single piece element comprising two coaxial gear wheels in side-by-side relation, the two coaxial gear wheels having different numbers of teeth, one of the two coaxial gear wheels being directly engaged with the gear wheel fixedly coupled to the supporting arm and the other one of the two coaxial gear wheels being directly engaged with the pinion fixedly coupled to the transducer shaft, said intermediate transmission element being arranged to be replaceable for gear ratio adjustment.

8. The single lever control of claim 1, wherein the single lever control has two transducers that are located in symmetrically opposed angular positions with respect to a center axis passing through the axis of the supporting arm and that are parallel to said lever in the neutral angular position.

* * * * *